US007502695B2

(12) United States Patent
DeVries et al.

(10) Patent No.: US 7,502,695 B2
(45) **Date of Patent: *Mar. 10, 2009**

(54) FLOW ASSURANCE MONITORING

(75) Inventors: Stanley DeVries, Gaithersburg, MD (US); Paul W. Forney, Laguna Hills, CA (US)

(73) Assignee: Invensys Systems, Inc., Foxboro, MA (US)

( * ) Notice: Subject to any disclaimer, the term of this patent is extended or adjusted under 35 U.S.C. 154(b) by 26 days.

This patent is subject to a terminal disclaimer.

(21) Appl. No.: 11/625,144

(22) Filed: Jan. 19, 2007

(65) Prior Publication Data

US 2007/0118303 A1 May 24, 2007

Related U.S. Application Data

(63) Continuation of application No. 10/964,825, filed on Oct. 15, 2004, now Pat. No. 7,171,316.

(60) Provisional application No. 60/511,642, filed on Oct. 17, 2003.

(51) Int. Cl.
*G01N 11/00* (2006.01)

(52) U.S. Cl. ..... 702/50

(58) Field of Classification Search ..... 702/50
See application file for complete search history.

(56) References Cited

U.S. PATENT DOCUMENTS 3,816,773 A * 6/1974 Baldwin et al. ..... 310/319
4,931,774 A * 6/1990 Bachman ..... 340/603
5,544,672 A * 8/1996 Payne et al. ..... 137/1
6,041,017 A 3/2000 Goldsberry
6,370,942 B1 4/2002 Dunfee et al.
6,540,021 B1 * 4/2003 Botrel ..... 166/250.08
6,832,515 B2 * 12/2004 Follini et al. ..... 73/152.02
2003/0056954 A1 3/2003 Headworth
2003/0196810 A1 10/2003 Vinegar et al.
2005/0011278 A1 * 1/2005 Brown et al. ..... 73/861.18
2006/0165344 A1 * 7/2006 Mendez et al. ..... 385/13
2007/0276169 A1 * 11/2007 Tohidi et al. ..... 585/15

* cited by examiner

*Primary Examiner*—Michael P. Nghiem
*Assistant Examiner*—Cindy H Khuu
(74) *Attorney, Agent, or Firm*—Fish & Richardson P.C.

(57) ABSTRACT

In one oil production operation, a fluid conduit transports a fluid from a well head to a floating production platform. To prevent an occurrence of formations that obstruct the flow of fluid in the fluid conduit, a forecast is made as to whether a flow assurance curve will intersect an operating curve of the fluid conduit. In the event that the operating curve and the flow assurance curve will intersect, the appropriate personnel may be alerted so that they may attempt to prevent the hydrate forming conditions from occurring in the pipe. Which personnel are alerted may be based on a level of criticality. The level of criticality may be based on an estimated time period remaining until the flow assurance curve and the operating curve will intersect.

20 Claims, 12 Drawing Sheets

600

FLOW ASSURANCE MONITORING

CROSS-REFERENCE TO RELATED APPLICATIONS

The present application is a continuation of U.S. patent application Ser. No. 10/964,825, filed Oct. 15, 2004, now allowed, which claims priority from U.S. Provisional Application Ser. No. 60/511,642, titled WELLHEAD FLOW ASSURANCE MONITORING SYSTEM, and filed on Oct. 17, 2003. The prior applications are incorporated herein by reference in their entirety.

TECHNICAL FIELD

This disclosure is directed to a monitoring system and software to detect flow assurance problems.

BACKGROUND

Some major oil and gas production operations, especially in deep water (e.g., undersea), can suffer major and possibly permanent damage due to the formation of compounds that block the flow of the fluid being produced. Particularly in undersea oil operations, the pipes that move the oil from the wellhead to the surface (also referred to as risers) may be subject to conditions that result in the formation of ice-like formations known as hydrates.

Such formations may block the flow of fluid to the surface. The formations also may damage the risers. For example, if a formation loosens, the underground pressure may be sufficient to propel the loose formation in a straight direction, which can rupture a sub-sea pipeline where it bends.

Such formations can take months to be removed, if they are able to be removed at all. As a result of this downtime, a major undersea well can lose large amounts of money per day, and the associated yield of the reservoir can be damaged as a result of these formations.

In addition to hydrates, other formations that block the flow of fluid may occur in the risers and other pipelines of the oil production operation. For example, asphaltenes and wax build-up may form in the pipelines. include oil and gas production, oil and gas processing, minerals processing, wood processing, waste and wastewater processing, and power generation. This general class of problems experienced by process industries has been referred to as "flow assurance" problems.

SUMMARY

In one aspect, a boundary beyond which operating conditions of a fluid conduit are conducive to an occurrence of formations within the fluid conduit is calculated, along with a curve representing operating conditions of the fluid conduit. A future intersection of the curve with the boundary is forecasted. The future intersection represents that the operating conditions of the fluid conduit will be conducive to an occurrence of formations within the fluid conduit.

Implementations may include one or more of the following. For example, to forecast the future intersection, a path of the boundary may be forecasted and a determination that the path of the boundary intersects the cure may be made. Alternatively, a path of the curve may be forecasted and a determination that the path of the curve intersects the boundary may be made. As another alternative the paths of the boundary and the curve may be forecasted and a determination made that the paths intersect.

To forecast a path of the boundary and/or the curve, the boundary and/or the curve at a future time may be forecasted. Determining that the path of the boundary intersects the path of the curve may include determining that the boundary at the future time intersects the curve at the future time.

To forecast the curve or the boundary at the future time a set of temperature or pressure history data may be read and a set a set of temperature or pressure forecasts may be calculated for the curve based on the set of temperature or pressure history data.

A time period remaining until the curve will intersect with the boundary may be estimated by, e.g., calculating an average time rate of change of the curve and estimating the time period remaining based on the average time rate of change of the curve. The average time rate of change of the boundary may be calculated and the estimate may be based on the average time rate of change of the curve and the average time rate of change of the boundary. The average time rate of change may be an average time rate of temperature or pressure change and the estimate of the time remaining may be an estimate of the time remaining until the curve will intersect with the boundary based on the an average time rate of temperature or pressure change. The intersection of the curve with the boundary may be at a pressure or temperature of intersection.

An alert message may be generated. A level of criticality may be determined based on the time period remaining until the second curve will intersect with the first curve and one or more entities may be determined based on the level of criticality. The alert message may be sent to the one or more entities.

The fluid conduit may be a pipe containing a fluid flow. The flow of fluid may include oil, methane, water, gas or sand. The pipe may be an undersea pipe. The boundary may be a hydrate formation boundary and the formations may be hydrates.

In another aspect, a time remaining until operating conditions of a fluid conduit are conducive to an occurrence of formations within the fluid conduit is calculated. A level of criticality is determined based on the time remaining and one or more entities associated with the determined level of criticality are determined. An alert message is generated and sent to the one or more entities.

Implementations may include one or more of the following. For example, a graph including the boundary and the curve may be created and a display that includes the graph may be provided. A display may be provided that includes an interface component that enables an entity that received the alert message to send a message to another entity that received the alert message. A display may be provided that includes an interface component that enables an entity that received the alert message to enter proposed changes to operating conditions of the fluid conduit and to initiate a simulation that determines an effect of the proposed changes on the boundary and the curve.

To estimate a time period remaining until the curve will intersect with the boundary, an average time rate of change of the curve may be calculated and a time period remaining until the curve will intersect with the boundary may be estimated based on the average time rate of change of the curve. The intersection may be at a temperature or pressure of intersection. An average time rate of change of the boundary may be calculated and the estimate of the time period remaining until the curve will intersect with the boundary may be based on the average time rate of change of the curve and the average time rate of change of the boundary.

The formations may be hydrates. The estimate may be an estimate of a time remaining until operating conditions of a fluid conduit are conducive to an occurrence of hydrates within the fluid conduit.

In another aspect, a system includes a historian, a data manipulation component, a curve calculation component, and a forecast component. The historian is configured to store data related to operating conditions of a fluid conduit. The data manipulation component is configured to read at least some of the data from the historian and perform processing on the read data. The curve calculation component is configured to calculate, based on the data processed by the data manipulation component, a boundary beyond which operating conditions of the fluid conduit are conducive to an occurrence of formations within the fluid conduit and calculate a curve representing operating conditions of the fluid conduit. The forecast component is configured to forecast a future intersection of the curve with the boundary. The future intersection represents that the operating conditions of the fluid conduit will be conducive to an occurrence of formations within the fluid conduit.

To perform processing on the read data, the data manipulation component may be configured to substitute a last known good value for at least one value in the read data when there is an indication that the at least one value is invalid; change a near-zero value in the read data to zero when there is an indication that the near-zero value should be zero; and replace a missing value in the read data with a value from a simulation.

In another aspect, a flow assurance curve and an operating curve representing a wellhead are generated. A determination is made as to whether the flow assurance curve and the operating curve will intersect within a predetermined time period. If an intersection is detected, a parameter associated with the forecasted path is processed to produce an estimated intersection time and generate at least one alert message.

The details of one or more implementations are set forth in the accompanying drawings and the description below. Other features will be apparent from the description and drawings, and from the claims.

DETAILED DESCRIPTION

Figure 1:
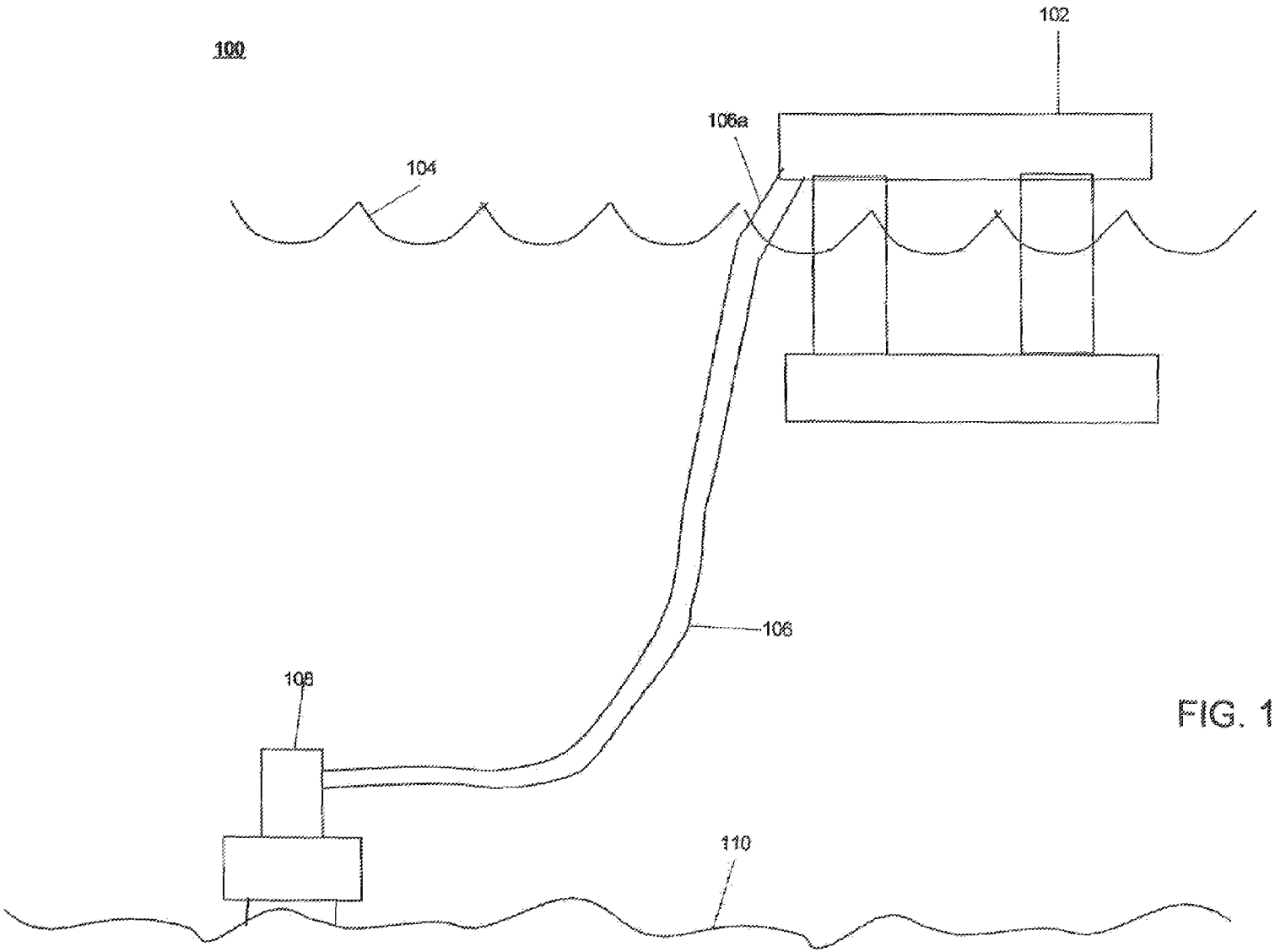
FIG. 1 is a diagram illustrating an oil production operation.

Referring to FIG. 1, in a typical undersea oil production operation 100, a floating production platform floats on the ocean surface 104. On the ocean floor 110 is a wellhead 108 for a well (not shown) that extends below the surface of the ocean floor 110. An undersea pipeline 106, typically known as a riser, connects the wellhead 108 to the floating production platform 102. In one operation, one or more risers normally extend for miles along the ocean surface between a wellhead and a surface point, such as the floating production platform 102. The riser 106 carries a fluid mixture from wellhead 108 to the floating production platform 102. The fluid mixture carried by riser 106 typically includes the fluid extracted from the well, e.g. oil, sand, methane, and water.

In order to monitor production, sensors are typically located at an end 106*a* of riser 106 near production platform 102. These sensors measure the pressure and temperature inside riser 106 at end 106*a* and the rate of flow of the fluid mixture inside riser 106 at end 106*a*. There may be other sensors located along riser 106 that measure temperature, pressure, and/or flow rate at other points along the length of riser 106. In addition, the composition, viscosity, and density of the fluid mixture is normally measured at production platform 102. Sensors also are normally placed to monitor the temperature of the ocean water at ocean surface 104 and the pressure insider riser 106 at wellhead 108.

Portions of the fluid mixture in riser 106 may form hydrates in riser 106 depending on various factors, such as the composition of the mixture, the temperature of the mixture, the pressure experienced by the mixture, the flow rate, viscosity, and density of the mixture, and the temperature of the water surrounding riser 106.

Figure 2:
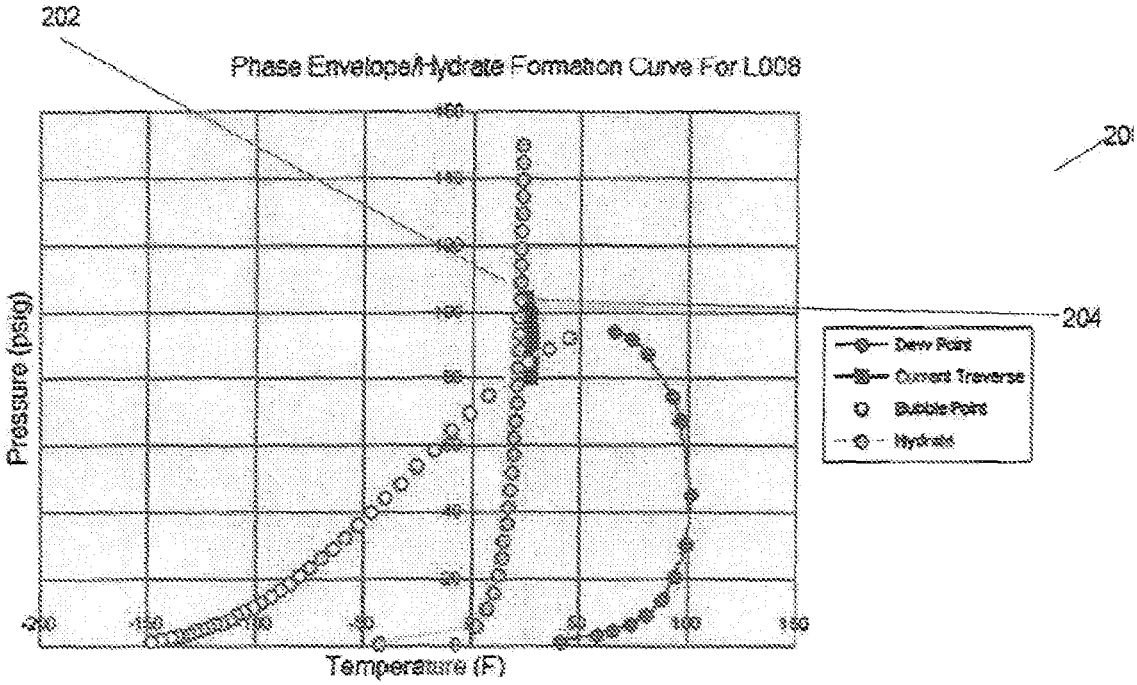
FIG. 2 is a graph showing a flow assurance curve and an operating curve for a fluid conduit.

Referring to FIG. 2, in general, to prevent the formation of hydrates, a periodic or aperiodic forecast is made as to whether a flow assurance curve 202 will intersect an operating curve 204 of the pipe carrying the fluid. The flow assurance curve 202 represents a hydrate formation boundary, i.e., the boundary beyond which operating conditions of a pipe are conducive to an occurrence of formations within the pipe. In other words, the flow assurance curve represents a boundary between conditions under which hydrates are likely to form and the conditions under which hydrates are not likely to form. The operating curve 204 represents the operating conditions of the pipe carrying the fluid at various points along the length of the pipe.

The flow assurance curve 202 and the operating curve 204 illustrated in graph 200 of FIG. 2 are shown in two-dimensions, namely, along the temperature and pressure dimensions. In general, however, these curves are multi-dimensional, with the factors leading to hydrate formation defining the dimensions of the curves. Accordingly, the flow assurance curve 202 shown in FIG. 2 represents, for the current values of the other factors effecting hydrate formation, the boundary between the temperature and pressure conditions under which hydrates form and the temperature and pressure conditions under which hydrates do not form. The operating curve 204 shown in FIG. 2 then represents the current temperature and pressure conditions at various points along the length of the pipe.

Over time, conditions in the pipe change, resulting in the flow assurance curve 202 and the operating curve 204 changing. By forecasting whether the operating curve will intersect the flow assurance curve 202 in the future, it is possible to predict whether the appropriate conditions for hydrate formation may exist in the future. To forecast whether flow assurance curve 202 and operating curve 204 will intersect, the paths of the flow assurance curve 202 and operating curve 204 may be forecasted and a determination may be made as to whether these forecasted paths intersect.

Alternatively, the path of only one of the curves may be forecasted. Depending on the environment, operating curve 204 may change more quickly relative to flow assurance curve 202 and vice versa. In such a situation, the path of the curve that moves more quickly may be forecasted, and a determination then may be made as to whether the forecasted path intersects the other curve. For example, in a typical undersea oil production operation, the flow assurance curve 202 moves more slowly than the operating curve. Accordingly, the path of only the operating curve may be calculated and a determination made as to whether the forecasted path of the operating curve intersects the flow assurance curve.

Similarly, the flow assurance curve 202 or the operating curve 204 may change more quickly along some dimensions relative to other dimensions. In such a situation, the path of one or both curves may only be forecasted along the dimension or dimensions that move quickly. For example, in a typical undersea oil production operation, the flow assurance and operating curves may move more quickly along the temperature and pressure dimensions relative to the other dimensions (such as, for example, a flow rate of the fluid). Accordingly, the path of one or both curves may be forecasted along only the temperature dimension, only the pressure dimension, or a combination of temperature and pressure dimensions.

In general, the following discussion describes one implementation in which the paths of both the operating curve and flow assurance curve are forecasted, but the paths are only forecasted along the temperature dimension, the pressure dimension, or a combination of the pressure and temperature dimensions.

In the event that the operating curve 202 and the flow assurance curve 204 will intersect, the appropriate personnel may be alerted so that they may attempt to prevent the hydrate forming conditions from occurring in the pipe.

Figure 3A:
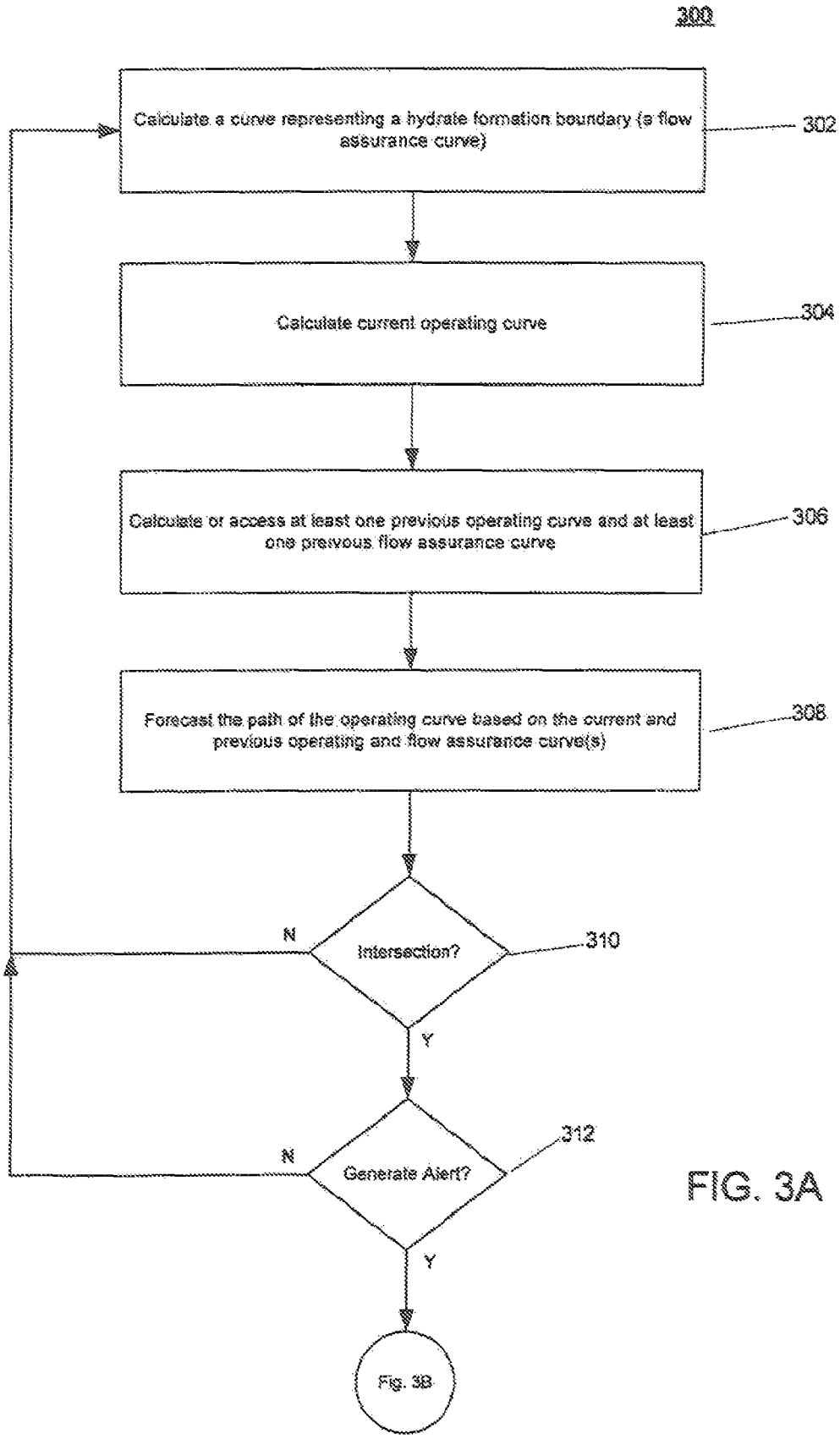
FIGS. 3A-3C are flowcharts illustrating a process for forecasting that operating conditions of a fluid conduit will be conducive to an occurrence of formations within the fluid conduit and generating alert messages.
Figure 3B:
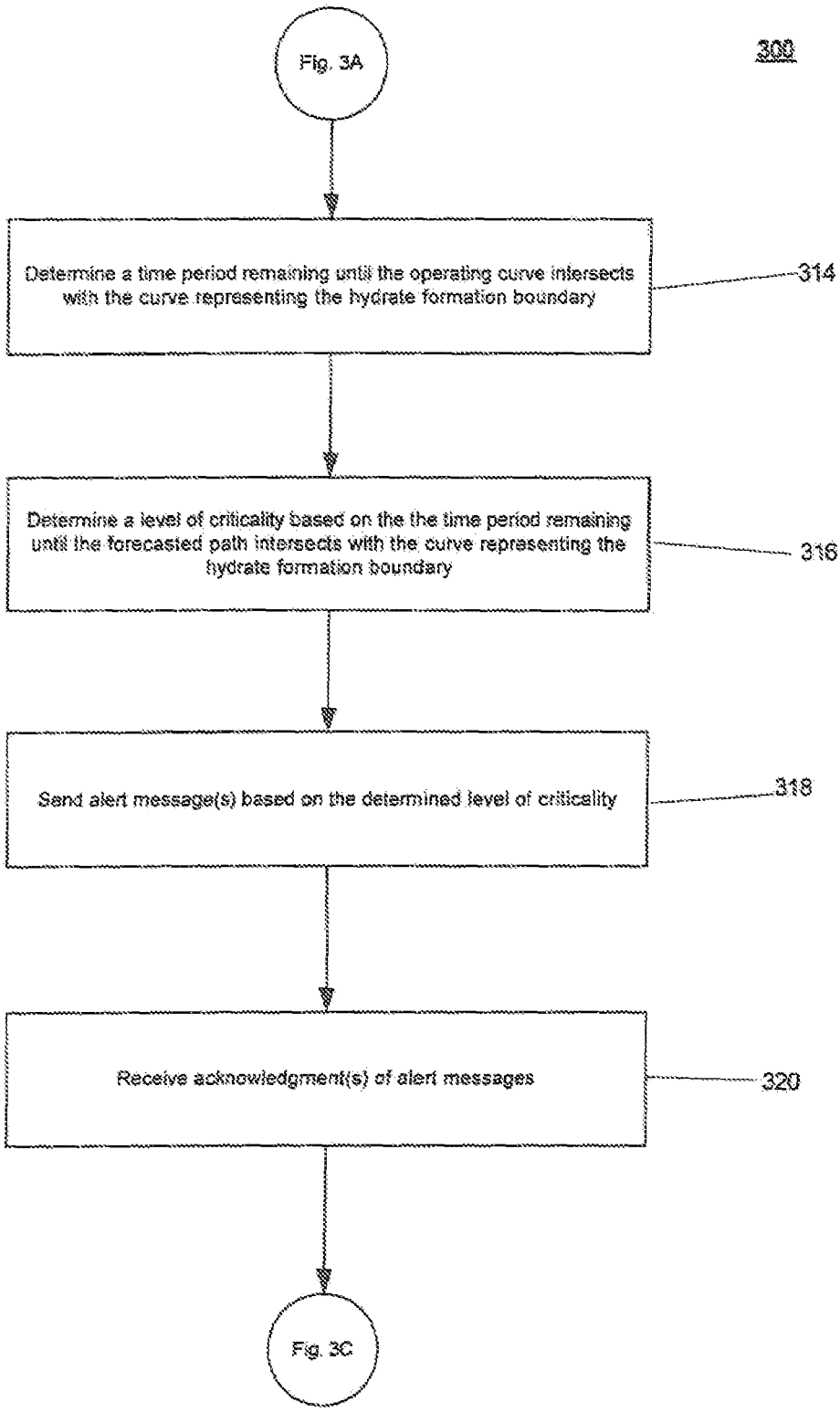
Figure 3C:
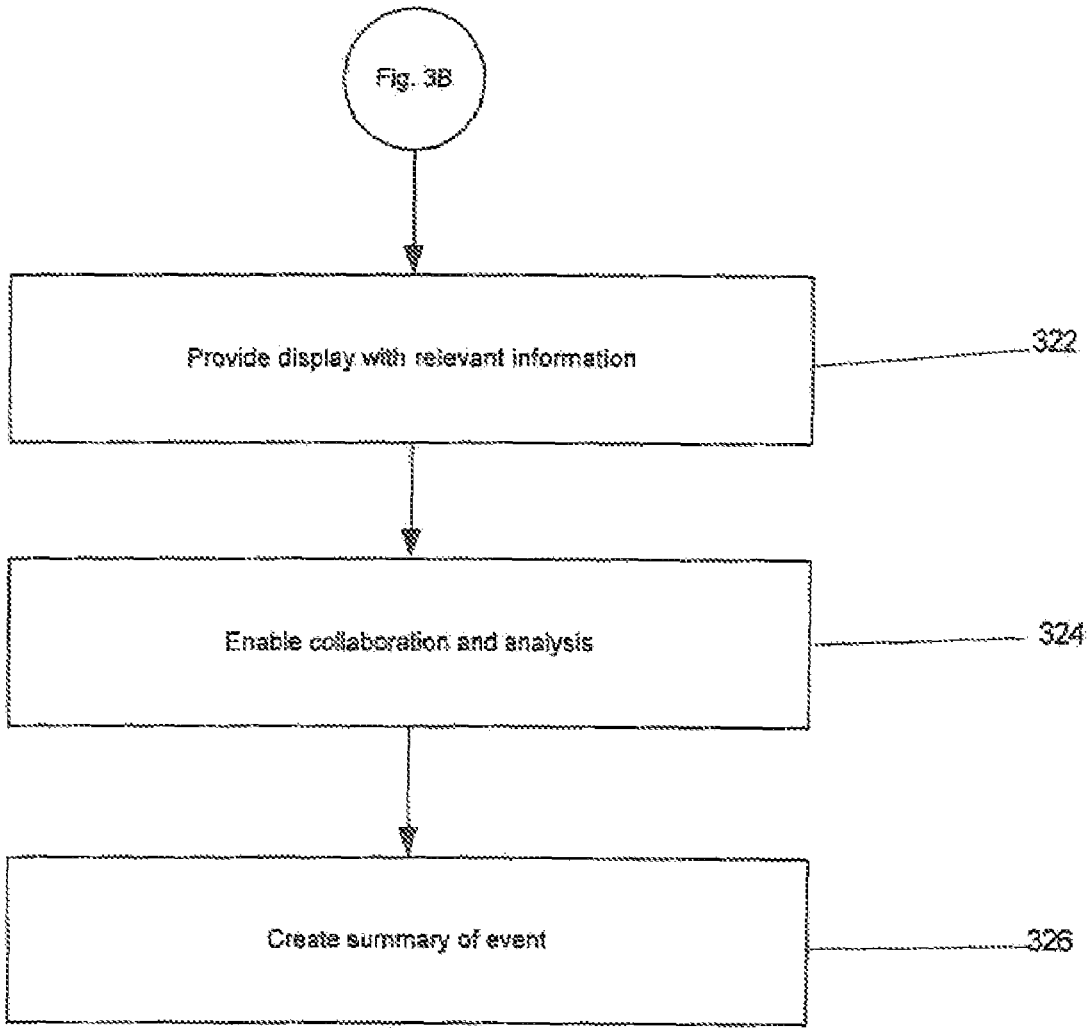

Accordingly, with reference to FIGS. 3A-3C, in the example process 300 (which may be implemented by a computer-based system), the hydrate formation boundary (e.g., a flow assurance curve) along the temperature and pressure dimensions is calculated for a pipe carrying a flow of fluid (302). For an undersea operation, hydrate formation depends on various factors such as, for example, temperature, pressure, flow rate of the fluid, viscosity of the fluid, and the temperature of the water surrounding the pipe. Thus, based on information regarding the current flow rate of the fluid, the current viscosity of the fluid, and the current temperature of the water surrounding the pipe, a temperature-pressure plot of the hydrate formation boundary may be calculated.

In addition, the current operating curve of the pipe along the temperature and pressure dimensions is calculated (304). Typically, for an undersea operation, the temperature and pressure in the pipe is known at least at one end of the pipe (normally at the end near the surface). In addition, the diameter and length of the pipe, along with the viscosity, density, and flow rate of the fluid is known. Based on this information, the temperature and pressure in the pipe at various points along its length may be calculated to produce an operating curve for the pipe.

At least one previous operating curve and at least one previous flow assurance curve are calculated or accessed (306). The previous operating curve(s) and flow assurance curve(s) may have been calculated in a previous iteration of process 300 and stored for use in the current operation. Alternatively, historical data regarding the operating conditions of the pipe may be accessed and used to calculate one or more previous operating curves and one or more previous flow assurance curves.

Based on the current operating curve and the at least one previous operating curve, the paths of the operating curve and the flow assurance curve are forecasted (308). To do so, for example, the magnitude of the shortest distance between the flow assurance curve 202 and the operating curve 204 may be calculated and compared to the magnitude of the shortest distance between the two curves at a previous point in time. If the magnitude of the shortest distance has decreased from the previous time, then one or more future flow assurance curves and future operating curves are forecasted, i.e., the flow assurance curve at one or more future times is forecasted and the operating curve at one or more future times is forecasted. The one or more future times may be determined by the threshold time levels described below such that, e.g., the curves are forecasted at one hour in the future, three hours in the future, and ten hours in the future.

A determination is then made as to whether the forecasted paths intersect (310), e.g., by determining whether the forecasted flow assurance curve at a future time intersects the forecasted operating curve at the same future time. For instance, the forecasted operating and flow assurance curves at one hour later may be compared to determine whether they intersect, the forecasted operating and flow assurance curves at three hours later may be compared to determine whether they intersect, and/or the forecasted operating and flow assurance curves at ten hours later may be compared to determine whether they intersect.

The forecasted paths and the determination may be made along one or both of the temperature and pressure dimensions. For instance, the forecasted paths may be based only on a future change in the temperature (or, alternatively, only the pressure), with the amount of the future change in temperature being used to determine whether a point on the operating curve will intersect the flow assurance curve along the temperature dimension. Alternatively, the forecasted paths may be based on both a future change in the temperature and pressure, with the amount of the future change of both being used to determine whether a point on the operating curve will intersect the flow assurance curve. As described above, in other implementations, the paths may be forecasted along other dimensions or combinations of dimensions.

In the event that the forecasted path and the flow assurance curve will not intersect (310), actions 302-308 may be repeated on a periodic or aperiodic basis to account for changes in conditions of the pipe, which result in changes to the flow assurance curve and the operating curve.

In the event that the forecasted path and the flow assurance curve will intersect (310), a determination is made as to whether an alert should be generated (312). Even though the forecasted path and the flow assurance curve will intersect, there may be a variety of reasons why an alert should not be generated. For instance, if there is information that indicates that sensors or other components of the system that provide information for calculating the flow assurance curve or the forecasted path are experiencing errors or are otherwise unreliable, then an alert may not be generated. Also, an alert may not be generated because the condition was detected on a previous iteration of actions 302-308 and an alert was generated during that iteration. Furthermore, an alert regarding the intersection of the forecasted path and the flow assurance curve may not be generated because there are higher priority problems or events to be handled. For instance, a fire or other emergency may have occurred on the floating platform that resulted in the operators reducing or terminating the flow of fluid in the pipe (reducing the flow rate or terminating the flow may lead to the forecasted path and the flow assurance curve intersecting). In such a situation, it may be desirable to suppress alerts regarding conditions of a lower priority so as to avoid inundating the operators and others with too many messages. Thus, in such a situation, the alert may be suppressed until higher priority events are resolved.

In the event an alert should not be generated (312), actions 302-308 may be repeated on a periodic or aperiodic basis to account for changes in conditions of the pipe, which result in changes to the flow assurance curve and the operating curve.

With reference to FIGS. 3A and 3B, if an alert is to be generated (312), then estimated rates of change of the operating curve and the flow assurance curve are calculated to determine the time remaining until intersection (and, consequently, the time period remaining until conditions exits under which hydrates may form) (314). The estimated rates of change of the curves may be based on one or both of the temperature or pressure dimensions of the operating curve. For instance, the average time rate of change of the temperature (or, alternatively, the pressure) may be calculated to estimate the time remaining until a point on the operating curve intersects the flow assurance curve along the temperature dimension. This estimate of the time remaining then may be used as the estimate of the time remaining until hydrate formation conditions exist in a portion of the pipe. Alternatively, the average time rate of change along both the temperature and pressure dimensions may be calculated and used to estimate the time remaining until a point on the operating curve intersects the flow assurance curve, with this estimate of the time remaining being used as the estimate of the time remaining until hydrate formation conditions exist.

As described above, in other implementations, the paths may be forecasted along other dimensions or combinations of dimensions. In such implementations, the average time rate of change of the operating curve along the dimensions used for the forecasted paths may be used to estimate the time remaining. Furthermore, as described above, in other implementations the path of only one of the curves may be forecasted to forecast whether an intersection will occur. Such implementations may use only the estimated rate of change of the curve for which the path was forecasted to estimate a time remaining until intersection.

Based on the time period remaining until the intersection, a level of criticality is determined (316). Higher levels of criticality may be assigned to shorter time periods, and the levels of criticality may have been set previously for predetermined lengths of time by a wellhead specialist or other personnel. For instance, a low level of criticality may be assigned for a time period of ten hours, a medium level of criticality may be assigned for a time period of three hours, and a high level of criticality may be assigned for a time period of one hour. In such a scenario, if the time period remaining until the forecasted path and the flow assurance curve intersect is between three and ten hours, a low level of criticality may be assigned. If the time period remaining is between one and three hours, then a medium level of criticality may be assigned, while a high level of criticality may be assigned if the time period is one hour or less. The time period remaining may be used to calculate a numerical value and that numerical value may be compared to a threshold value to determine the level of criticality.

Based on the level of criticality, alerts may then be sent out to appropriate personnel (318), who may adjust operating conditions to try and prevent hydrate formation. For an oil production operation, there may be a variety of personnel with varying expertise and roles in operating the well and preventing hydrate formation. A production engineer may provide operational advice to help balance the short-term and long-term business needs, and may have some expertise in preventing hydrate formation. A wellhead specialist may have the most expertise in preventing hydrate formation and providing the appropriate operating conditions to achieve the goals set forth by the production engineer. An operator may be the one who effects operational changes and may have the least expertise in determining appropriate operating conditions and preventing hydrate formation. Depending on the level of criticality, one or more of the various personnel may be alerted to appropriately provide their expertise and knowledge to prevent the formation of hydrates, while at the same time meeting the business and other goals of the operation.

For example, if the level of criticality is high, then an alert may be sent to a wellhead specialist, production engineer, and operator. For a medium level of criticality, an alert may be sent only to a production engineer and an operator, while for a low level of criticality, an alert may be sent only to an operator.

The specific users that are alerted may have been assigned previously by their functional supervisors. For instance, a technical supervisor may assign one or more specific wellhead specialists "on call" should their assistance be necessary. An operations supervisor may assign spans of control for operators for each shift.

Providing alerts based on the level of criticality may help to provide security and privacy of information. For example, some of the personnel (e.g., wellhead specialists) may be contractors for the entity running the operation (and may in fact be otherwise employed by entities that are competitors in other industry segments). Consequently, it may be desirable not to make information available to those individuals, except when necessary. In addition, providing alerts based on the level of criticality helps to insure only the needed people receive alert messages, thereby preventing people from being overloaded with alerts when their expertise is not yet needed, if at all.

Each of the individuals may have one or more alert mediums available. For instance, individuals may be alerted by e-mail, pager, cell phone, instant messaging, or a control system alarm message. For a given individual, the alert may be sent by one or more of the possible alert mediums. If a particular individual is not available by any of the possible alert mediums (e.g., a person is to be alerted by instant messaging, but the person is not logged on to the instant messaging system), then the alert may be sent to an alternate individual, such as the individual's supervisor. Similarly, if an individual waits too long to acknowledge the alert (as described below), an alert may be sent to an alternate individual.

The alert message may contain a wellhead identifier, an estimated time until intersection, and depending on the medium of the alert (e.g., if the medium is e-mail or instant messaging), a hyperlink (containing, e.g., a uniform resource locator (URL)). The recipient of the alert then may acknowledge the alert by clicking on the hyperlink. Clicking on the link may invoke a web browser, which sends a hypertext transfer protocol (HTTP) request for the URL. As a result, the acknowledgement is received by a system implementing process 300 and the system records the time the acknowledgement was received (320).

Referring to FIG. 3C, the system then provides a display containing relevant information (322). For instance, the system may redirect the web browser that sent the HTTP request to a web page containing the display. The display may contain, for example, a temperature-pressure phase plot containing the flow assurance curve and the operating curve, the estimated time to intersection of these curves, information indicating the notified individuals and their roles, and links to related information.

The system also enables the alerted individuals to collaborate and analyze possible solutions to prevent the occurrence of hydrate formation conditions (324). To enable collaboration, the system may provide an interface to send messages between the various individuals that have been sent an alert message. The interface may be part of the display containing relevant information or may be separate. After an individual sends a message using the interface, the system may determine the best medium for delivering the message to the intended recipient and send the message through that medium.

To enable the analysis, the system may provide an interface that allows users to enter proposed changes to the operating conditions of the pipe and to simulate the effects of those changes on the operating curve, the flow assurance curve, the forecasted path of the operating curve, and/or the forecasted path of the flow assurance curve. The interface may be part of the display containing relevant information, or may be a separate interface. The system may display the effects the proposed changes have on the operating curve of the pipe, the flow assurance curve, the forecasted path of the operating curve, and/or the forecasted path of the flow assurance curve.

The system also creates a summary for the event resulting in the alert (326). The summary may automatically include the time at which the condition was detected, type of condition, condition details as appropriate (e.g., wellhead identifier, time to intersection), the flow assurance curve (e.g., pressure-temperature pairs), the historical path of the operating curve, the forecasted path of the operating curve, the forecasted path of the flow assurance curve, the individuals notified, who acknowledged the alert and when, and participating individuals and their roles. The summary may be accessible to some or all of the individuals, who may then annotate the summary with notes and the action taken to alleviate the condition.

Figure 4:
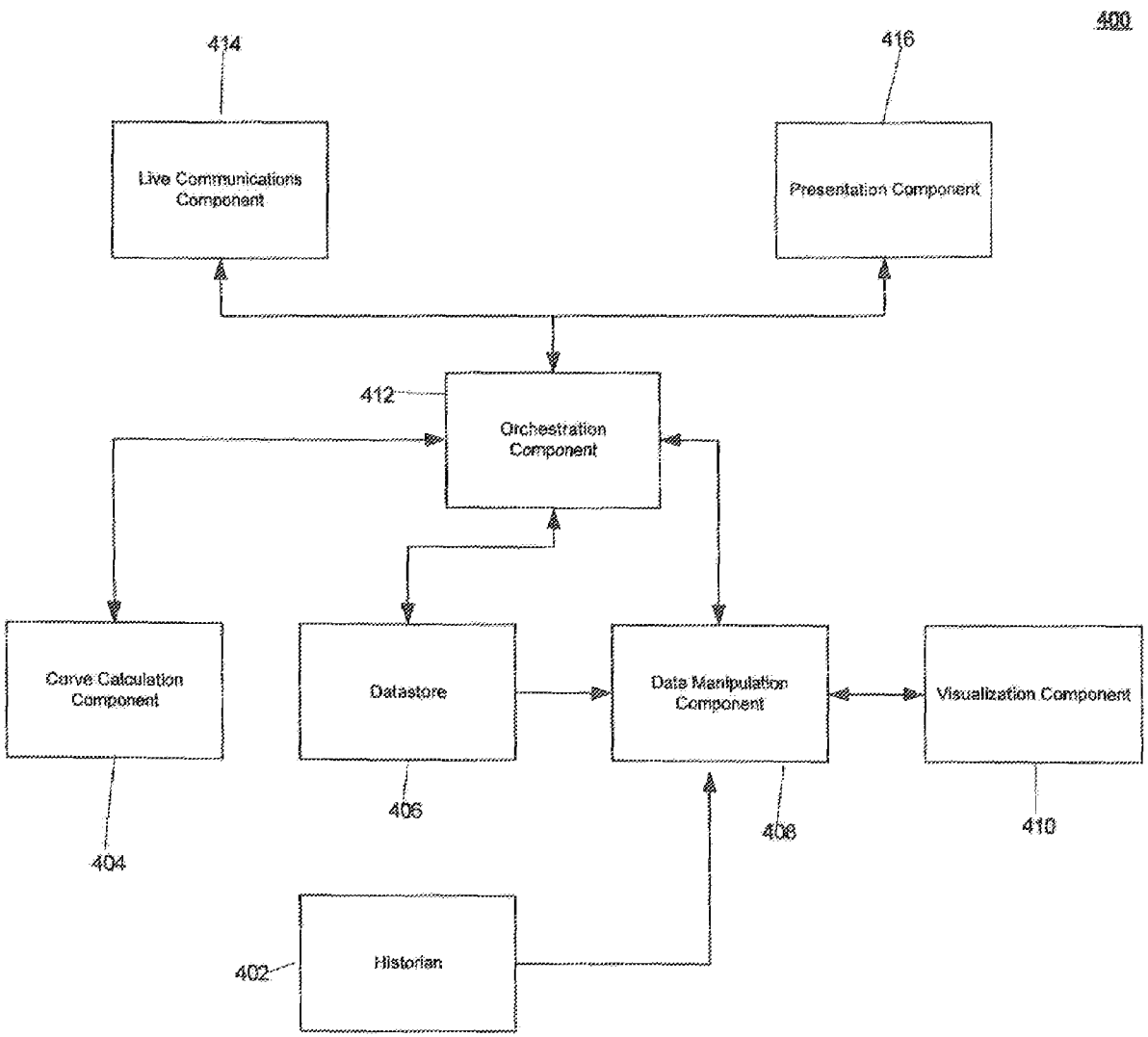
FIG. 4 is a block diagram illustrating a system for forecasting that operating conditions of a fluid conduit will be conducive to an occurrence of formulations within the fluid conduit and generating alert messages.

FIG. 4 shows an example of a system 400 for implementing the process 300. System 400 includes a historian 402, a curve calculation component 404, a datastore 406, a data manipulation component 408, a visualization component 410, an orchestration/forecast component 412, a live communications component 414, and a presentation component 416. These components may be implemented as software executing on one or more computing devices.

The historian 402 stores current and historical readings regarding conditions in and around the riser(s). For example, historian 402 may store recent and historical readings of the flow rate of the fluid, viscosity of the fluid, density of the fluid, the ambient temperature of the water, and the temperature and pressure at one end of the riser(s) and/or along various positions of the riser(s). This information may be read from sensors placed at various points inside or along the riser(s) and/or the wellhead. Historian 402 also may store other information about the operations, such as data collected from controllers and other equipment.

The curve calculation component 404 uses the current readings stored in the historian to calculate the flow assurance curve and the operating curve. The curve calculation component 404 also may use the historical readings stored in historian 402 to calculate at least one previous operating curve and at least one previous flow assurance curve if one or more previous operating curves and flow assurance curves are not available as a result of previous iterations of process 300. That is, operating and flow assurance curves from previous iterations of process 300 may be stored as a set of operating and flow assurance curves for use in forecasting the path of the curves. If curves from previous iterations are not available, however, curve calculation component 404 may use historical readings stored in historian 402 to calculate at least one previous operating curve and at least one previous flow assurance curve for use in forecasting the path of the curves. In addition, curve calculation component 404 may calculate simulate new curves based on proposed changes to the operating conditions of the pipe.

Datastore 406 is used to store various data used or produced by orchestration component 412, curve calculation component 404, and visualization component 410. For example, datastore 406 may store the forecasted path of the operating curve and/or flow assurance curve, the average time rate of change of the operating curve and/or flow assurance curve, the current and previous operating curves, the current and previous flow assurance curves, and simulated flow assurance curves and operating curves based on proposed changes.

In general, data manipulation component 408 places data from the various components into data structures that can be used by other components. The components used in system 400 may use proprietary and/or diverse data formats such that the data needs to be restructured before another component of system 400 can operate on the data. For instance, historian 402 may store the current and recent readings in a data format that can not be used natively by curve calculation component 404. Consequently, data manipulation component 408 may retrieve the current and/or historical readings and reformat that data into a data structure that can be used by curve calculation component 404.

Data manipulation component 408 also may perform processing on the current and/or historical readings retrieved from historian 402 before making this data available to curve calculation component 404. The processing may be used to insure the reliability of the calculations performed by curve calculation component 404 and to speed the calculations performed by curve calculation component.

For instance, data manipulation component 408 may substitute a last known good value when there are indications that the value of the current reading may be invalid. For example, data that arrives from remote sensors is prone to transmission and other errors. Transmission diagnostic information accordingly may be used to determine if data is likely invalid and, if so, to substitute the last known good value of the data.

In addition, rate of change information may be used to determine if data is likely invalid. For some data, it may be known that it is not physically possible for the data to change greater than a certain rate. Therefore, if the changes in the data over one or more readings exceeds a certain threshold, a last known good value may be substituted for the current reading.

Similarly, for instance, data manipulation component 408 may detect when near-zero values should be zero and change the data accordingly. For example, when the flow of fluid has been reduced to zero, sensor data may nevertheless still provide a non-zero reading. Data manipulation component 408 may detect that such readings should be zero and change them appropriately. As another example, data manipulation component 408 may set bias factors to zero when such factors are too small to be reliably used.

Calculations such as calculating the flow assurance curve, calculating the operating curve, and calculating the effects of proposed changes on the system are based on estimations of parameters of the pipe or other components (e.g., the pipe diameter may vary because of coatings or build-up on the inside walls of the pipe). As a result, bias factors may be used in the calculations to account for such variations in the parameters. These bias factors are typically input by the user, who inputs the parameters for use by the simulation or calculation. In some cases, however, the bias factors may be too small to provide reliable simulations and/or calculations, such as the curve calculations performed by curve calculation component 404. Before data manipulation component 408 makes bias factors available to a simulation and/or calculation, data manipulation component 408 may compare the bias factors to a threshold, and, if they are below the threshold, set them to zero. The value at which a bias factor is too small depends on the system. Thus, determining such thresholds is typically a matter of design and may be system dependent.

As another example, data manipulation component 408 may use simulations to fill in data that is not available. For example, a sub-sea sensor may stop working, or newer equipment may have been installed with more sensors. Accordingly, for instance, there may be different amounts or types of data for each branch or position of the pipelines between the wellheads and the surface (e.g., there may be relatively frequent readings of the ambient water temperature along positions of the pipe near the surface, but less frequent readings closer to the wellhead). In other words, because there may be more sensors at one branch or position along the pipelines than others, there may be more data available from that position than others. However, it may be more efficient and reliable to calculate the flow assurance curve, the operating curve, the forecasted path, and/or the average time rate of change based on data sets that are the same size with corresponding data points. Thus, for example, data manipulation component may use nodal analysis or other techniques to calculate the missing data.

Data manipulation component 408 may relay on various data, related or non-related to the hydrate formation prediction, to perform such processing on the data used to calculate the flow assurance curve and the operating curve.

Visualization component 410 produces the various graphs and other visualizations presented to users based on data in datastore 406 and/or calculations performed by curve calculating component 404. For example, visualization component 410 produces the graph showing the current flow assurance curve and operating curve, along with the graphs showing the effects of proposed changes to various operating conditions of the pipe.

Orchestration/forecast component 412 forecasts the paths of the operating and flow assurance curves, and determines the time remaining until the flow assurance curve and the operating curve intersect. Orchestration component 412 also determines the level of criticality, and determines whether alerts should be generated and, if so, to whom they should be sent. Orchestration component 412 coordinates the sending of messages between the alerted parties and logs the messages sent between alerted parties, along with other aspects of the collaboration between the parties and the conditions that generated the alert. In addition orchestration component 412 handles the assignments of personnel who receive alerts based on the level of criticality and the assignments of the corresponding thresholds for the levels of criticality.

Orchestration component 412 also may coordinate and schedule the operations of other components and the transfer of data between components in the system. For instance, orchestration component 412 may instruct data manipulation component 408 when to begin accessing data in historian 402, perform processing on the data and restructure the data from historian 402, and provide the processed and restructured data to orchestration component 412. Orchestration component 412 may then coordinate when the processed data is made available to curve calculation component 404 and instruct curve calculation component 404 when to begin processing the data to calculate the flow assurance curve and the operating curve.

Orchestration component 412 also coordinates when curve calculation component 404 should begin calculations to determine the effects of proposed changes to the operating conditions of the pipe on the operating curve. In addition, orchestration component 412 coordinates when data manipulation component 408 should access data in datastore 406, restructure the data, and provide the restructured data to visualization component 410 for the visualization component 410 to create graphs or other visual representations of the data.

Orchestration component 412 may control the scheduling of the various calculations and simulations in a manner that ensures the data for the simulations or calculations is available and decreases the overall processing time. For instance, simulations and other calculations that use multiple inputs may be scheduled to ensure they don't start until the slowest source of an input has the input ready. Also, simulations and other calculations that provide input to common, subsequent simulations, and calculations may be scheduled to use concurrent data.

In addition, orchestration component 412 may monitor the various calculations and simulations as they are being performed. Generally, the length of time for a simulation or calculation to complete may be known. Thus, by monitoring the length of time that a simulation or calculation has been processing, orchestration component 412 can determine whether the simulation or calculation is experiencing problems. In the event a simulation or calculation is experiencing a problem, orchestration component 412 may restart the simulation or calculation. In the event of persistent failures on the part of a simulation or calculation, orchestration component 412 may send an alert to an assigned specialist, who may then diagnose and correct the problem with the calculation or simulation.

Other diagnostic mechanisms may be implemented. For instance, the various simulations and calculations may provide a heartbeat signal to the orchestration component 412. Orchestration component 412 also may use the heartbeat signal to determine whether the simulation or calculation is experiencing problems.

Live communications component 414 handles the delivery of alert and other messages to the users over the possible communication mediums. Live communications component 414 may determine whether a user is logged on, and if so, at what address (e.g., e-mail address or instant messaging address) the user is available based on where the user is logged on. Live communications component 414 then may send the messages via the medium at which the user is available.

Presentation component 416 handles providing a visualization of data (e.g., the graphs generated by visualization component 410) to the users along with interface components that provide for collaboration, simulation of the effects of proposed changes to the operating conditions of the pipe, and administrative interfaces to, e.g., assign the personnel that receive alerts based on levels of criticality and to assign thresholds for the levels of criticality. For instance, presentation component 416 may provide the web pages of interfaces 500, 700, and 800 shown in FIGS. 5, 7A, 7B, 8A, and 8B.

Accordingly, for a typical iteration or process 300, orchestration component 412 first instructs data manipulation component 408 to obtain current and/or historical readings from historian 402, perform processing on the readings and restructure the data of the readings, and provide the processed and restructured readings to orchestration component 412. Orchestration component 412 then provides these readings to curve calculation component 404, which calculates the current flow assurance curve and the current operating curve and returns them to orchestration component 412. If previous operating and flow assurance curve(s) are needed for the forecast of the paths (e.g., they are not available from previous iterations of process 300), curve calculation component 404 also calculates the previous operating and flow assurance curves and returns them to orchestration component 412. Orchestration component 412 then stores the current flow assurance curve and the current operating curve in datastore 406, and may store the set of previous operating and flow assurance curves, if calculated. Orchestration component 412 then uses the current operating and flow assurance curve and the set of previous operating and flow assurance curves to forecast the paths of the curves, and determines whether the forecasted paths intersect. In the event that the paths intersect, orchestration component 412 determines whether an alert message should be generated or whether the alert message should be suppressed. If an alert message should be generated, orchestration component 412 then calculates the estimated rates of change of the operating curve and flow assurance curve, and uses the estimated rates of change to determine the time remaining until intersection. Based on the time remaining, orchestration component 412 determines a level of criticality and determines who to alert based on the level of criticality.

Orchestration component 412 then generates the alert message and passes the alert message to live communications component 414, along with an indication of the intended recipients of the alert message and the possible alert mediums for the intended recipients. Live communications component 414 determines whether the intended recipients are available through the possible mediums and, if so, delivers the alert message. If the intended recipients are not available, live communications component 414 informs the orchestration component 412, which instructs live communications component 414 on how to proceed (e.g., send the alert message to a supervisor of the individual who is unavailable).

Orchestration component 412 also instructs data manipulation component to access the current flow assurance curve and the current operating curve from datastore 406, restructure the data, and provide the restructured data to visualization component 410. Visualization component 410 then produces the graph showing the flow assurance curve and the operating curve and returns the graph to data manipulation component 408, which provides the graph to orchestration component 412. Orchestration component 412 makes the graph available to presentation component 416.

The alert message may contain a hyperlink, which an individual selects to acknowledge the alert message. When the individual selects the hyperlink, a request is sent to presentation component 416, which passes the request to orchestration component 412. Orchestration component 412 logs that the individual has acknowledged the alert message and instructs the presentation component 416 to provide to the user a display that contains the relevant data.

Presentation component 416 then provides a display containing the graph and other relevant information. The display also contains interface components that allow the individual to send messages to other parties who have received the alert message and that allow the individual to simulate the effects of proposed changes to the operating conditions of the pipe on the operating curve.

In the event the individual sends a message to another party via the interface component, presentation component 416 passes the message to orchestration component 412, along with information regarding the intended recipient. Orchestration component 412 then logs the message and passes the message to live communications component 414 for delivery.

In the event proposed changes are input, presentation component 416 provides the proposed changes to orchestration component 412, which logs the proposed changes and passes them to curve calculation component 404. Curve calculation component 404 then re-calculates the operating and flow assurance curve based on the proposed changes, and provides the re-calculated flow assurance and operating curve to orchestration component 412.

Orchestration component 412 then forecasts the paths of the re-calculated operating and flow assurance curves and determines whether the forecasted paths will intersect. If so, orchestration component 412 estimates a time remaining until intersection.

Orchestration component 412 also provides the re-calculated operating and flow assurance curves to data manipulation component 408, which restructures the data as appropriate, and provides the restructured data to visualization component 410. Visualization component 410 creates a graph of re-calculated operating and flow assurance curves and returns the graph to data manipulation component 408.

Data manipulation component 408 passes the graph to orchestration component 412, which makes the graph and the new estimated time remaining (if any) available to presentation component 416. Presentation component 416 then presents this information to the user.

Orchestration component 412 also uses the logged and otherwise stored information to create a summary for the event resulting in the alert. This summary is made available to presentation component 416 such that, if a user makes a request to view the summary, presentation component 416 can present the summary to the user and provide the user with an interface component for adding annotations to the summary.

Figure 5:
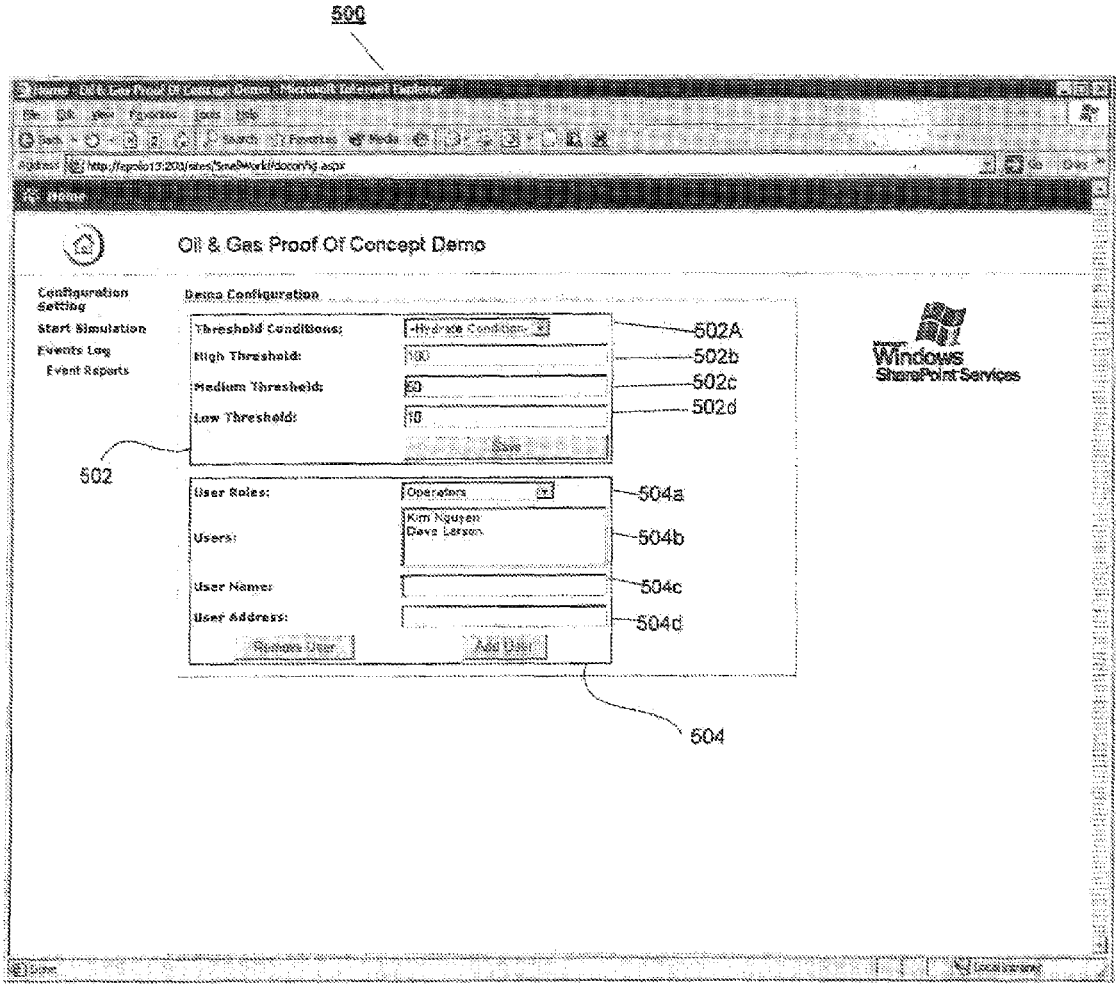
FIG. 5 is an illustration showing an interface that allows a user to set the levels of criticality and designate the personnel that will be alerted depending on the levels.

FIG. 5 illustrates an example of an interface 500 that allows a user to set the levels of criticality and designate the personnel that will be alerted depending on the levels. The interface is a web browser that displays a web page designed to allow the user to set the levels of criticality and designate the personnel hat will be alerted depending on the levels.

Interface 500 includes a section 502 that allows the user to designate the condition that results in an alert and thresholds that correspond to the levels of criticality. Section 502 includes a drop-down box 502*a* that allows the user to select the condition that results in the alert, e.g., when the flow assurance curve and the forecasted path will intersect. Text boxes 502*b*-502*d* allow the user to indicate a threshold for high, medium, and low levels of criticality, respectively.

Interface 500 also includes a section 504 that allows a user to designate the personnel that will be alerted in the event that the condition indicated in drop-down box 502*a* occurs. Section 504 includes a drop-down box that allows the user to select a designated role for the users to be alerted. A list box 504*b* displays the current users that will be alerted and that have the role designated in drop-down box 504*a*. Box 504*c* allows the operator to add the name of a user to be added and box 504*d* allows the user to designate an address (e.g., e-mail or instant messaging address) to which alerts may be sent. As shown in FIG. 5, the current role selected is operators. As a result, any new users added will have the role of operators and the box 504*b* displays the names of the personnel currently designated as operators.

Figure 6:
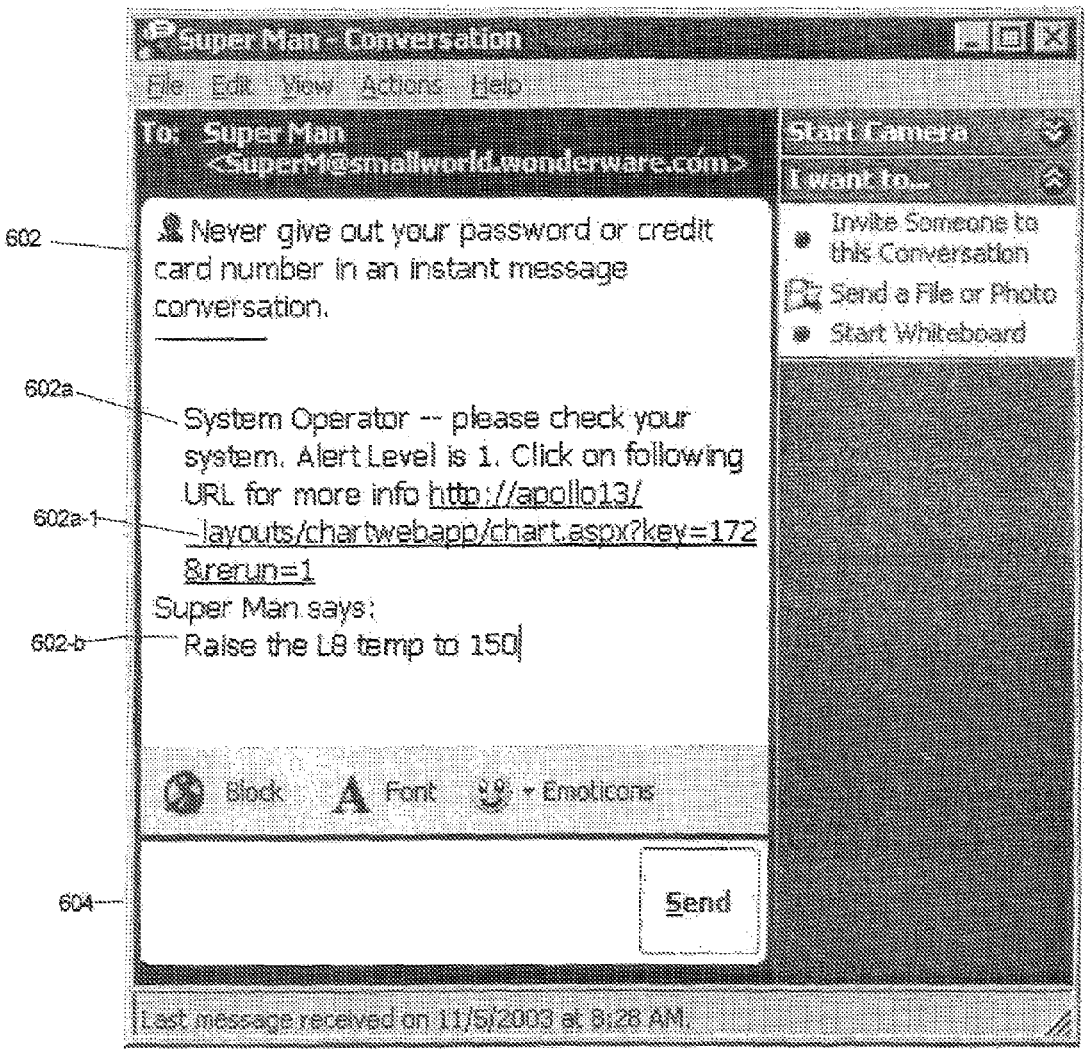
FIG. 6 illustrates an example of an instant messaging interface that may be used to provide alert messages and allow collaboration among the various personnel alerted.

FIG. 6 illustrates an example of an instant messaging interface 600 that may be used to provide alert messages and allow collaboration among the various personnel alerted. Instant messaging interface 600 includes an area 602 that displays received messages. Interface 600 also includes an area 604 that allows the user of the interface 600 to send messages to other personnel.

The interface 600 includes an alert message sent to the user (which is an operator) of the interface 600. The alert message includes a hyperlink 602*a*-1, which the user may select to invoke a web browser (such as the one shown in FIG. 7A). The web browser sends a request to presentation component 416, which passes the request to orchestration component 412 to log the user as responding to the alert message. Orchestration component 412 then instructs presentation component 416 to redirect the browser to a display containing relevant information (such as the one shown in FIG. 7A). Interface 600 also shows a message sent to the user by another one of the personnel, e.g., a production engineer).

Figure 7A:
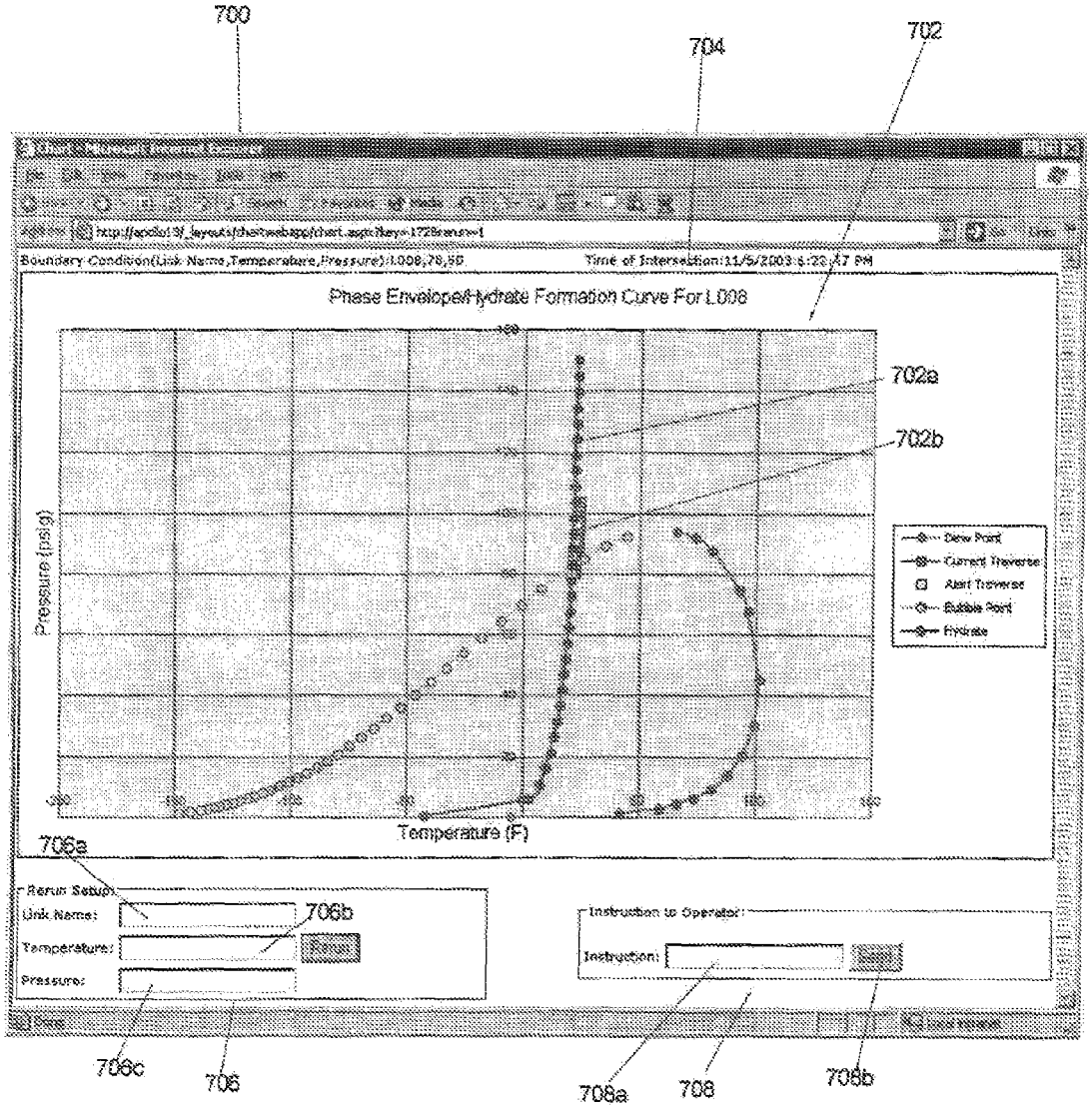
FIGS. 7A and 7B are illustrations showing an interface that includes a display of information relevant to an alert.

FIG. 7A illustrates an example of an interface 700 that includes a display of information relevant to the alert. The interface 700 is a web browser that displays a web page designed to provide the display of relevant information. Interface 700 may be invoked when a user selects a hyperlink containing an alert message.

Interface 700 includes a graph 702 that displays the current flow assurance curve 702*a* and current operating curve 702*b*. Interface 700 also includes an indication 704 of the estimated time that the flow assurance curve 702*a* and operating curve 702*b* will intersect.

A section 706 allows a user to enter proposed changes to run a simulation of the effects of those proposed changes on the relationship between the flow assurance curve 702*a* and the operating curve 702*b*. Section 706 includes a box 706*a* to designate a link between pipe sections and boxes 706*b* and 706*c* that allow the user to designate a proposed temperature and pressure for the link. In other implementations, interface 700 may allow, for example, a user to adjust the flow rate of the fluid in the pipe or other operating conditions. Once these proposed parameters are entered into boxes 706*a*-706*c*, the user may select button 706*d* to stimulate the effects of these proposed changes on relationship between the flow assurance curve 702*a* and the operating curve 702*b*.

A section 708 allows a user to enter and send messages to the other personnel that have been sent an alert. In the interface 708 shown, the only other personnel (besides the user viewing interface 700, e.g., a production engineer) is the operator and, therefore, only a section for sending a message to the operator is shown. Section 708 includes a box 708*a* for entering a message. When a user selects button 708*b*, the message entered into box 708*a* is sent to the operator. When other personnel are alerted, a section for sending messages to those personnel also may be displayed.

Figure 7B:
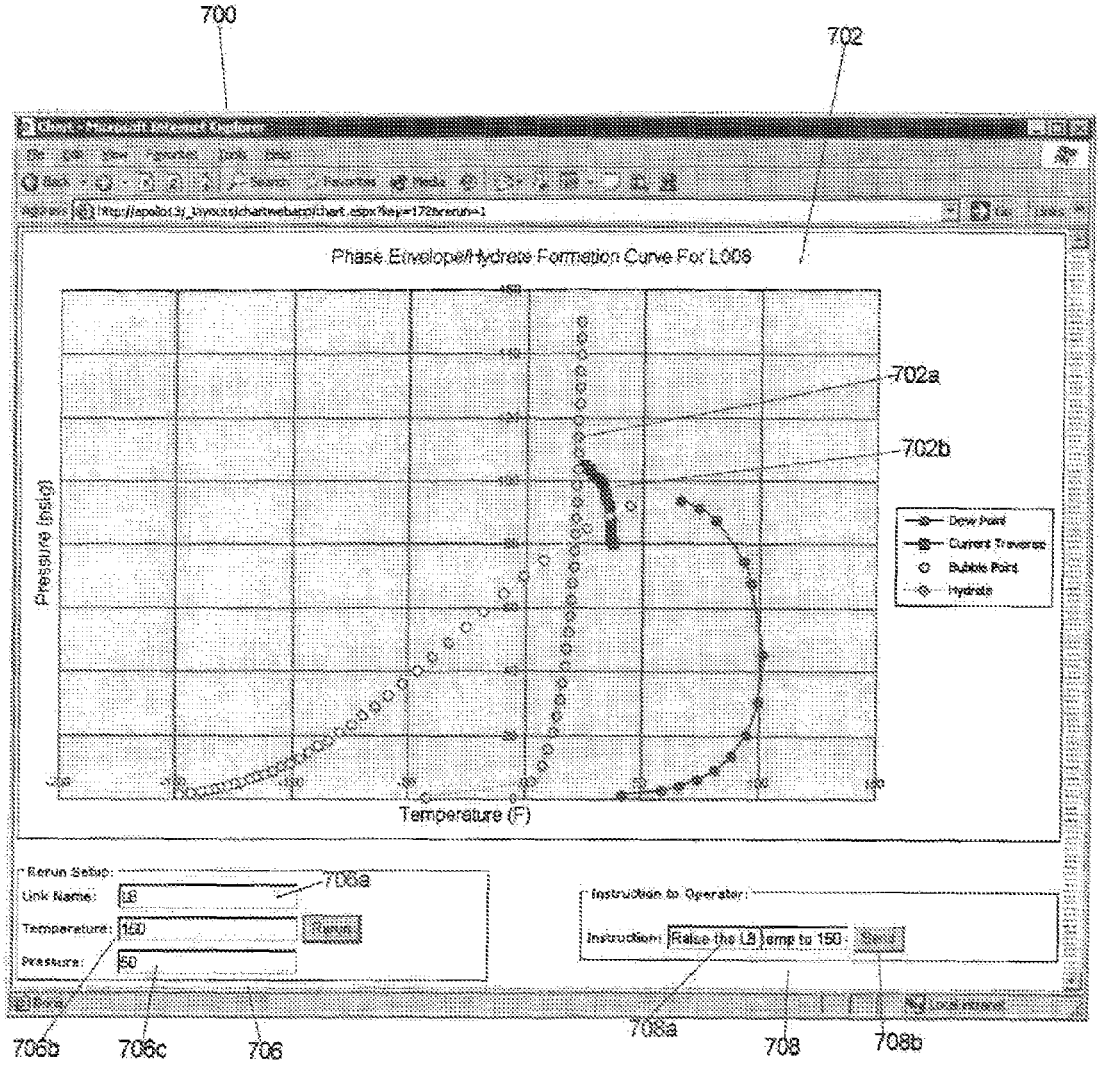

FIG. 7B illustrates the interface 700 after proposed changes have been simulated. The new positions of the flow assurance curve 702*a* and the operating curve 702*b* are displayed. These new positions are simulated based on the parameters entered into boxes 706*b*-706*c*. If an intersection still occurs, then the new estimation of the time of intersection also is displayed. In FIG. 7B, the simulated changes eliminate the intersection and, therefore, an estimated time is not displayed. Also in FIG. 7B, a message to the operator is shown in box 708*a*. When the user selects button 708*b*, the live communications component 414 determines that the operator is available via, e.g., instant messaging (as shown in FIG. 6) and sends this message to the operator such that it is displayed on the instant messaging interface of the operator (see 602*b* of FIG. 6).

Figure 8A:
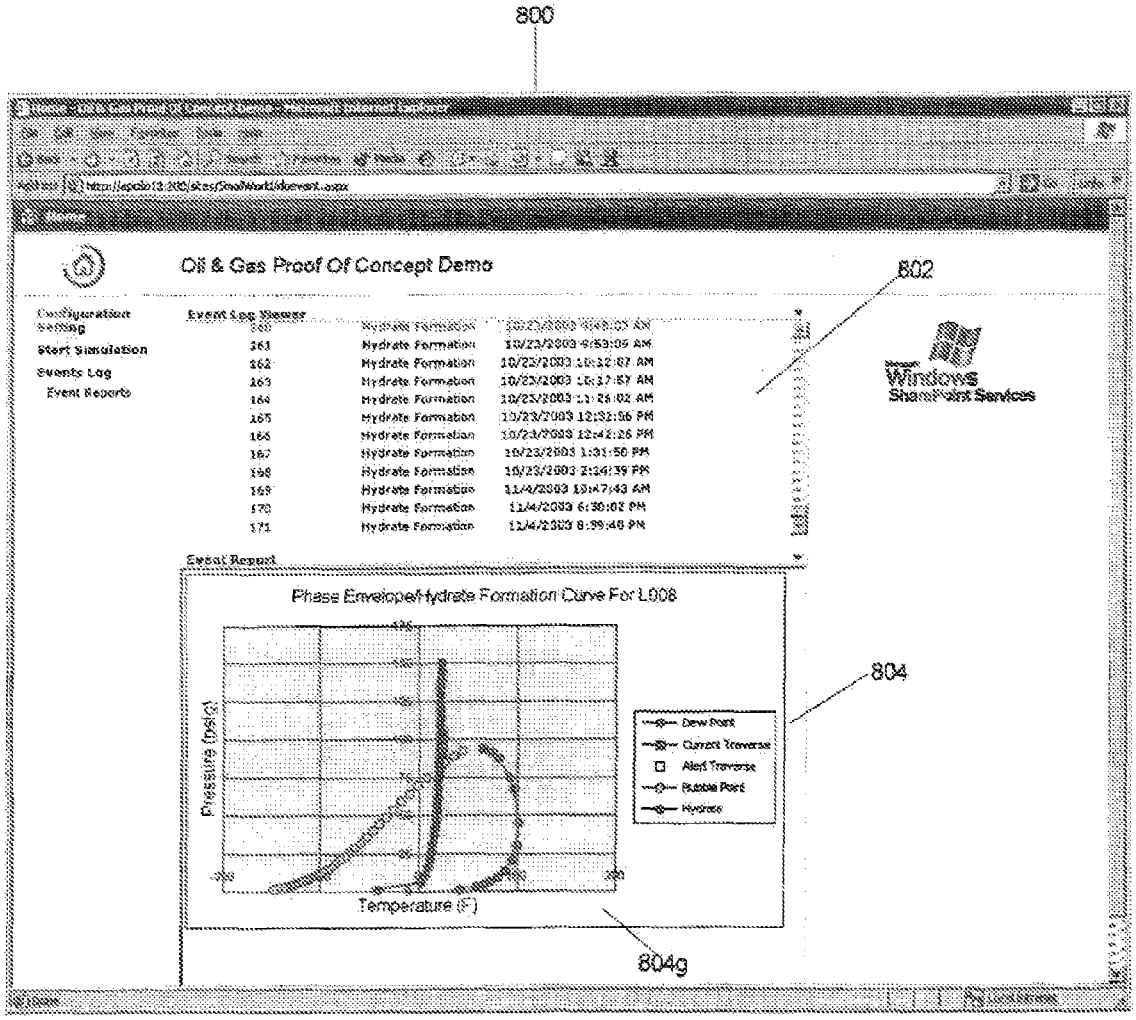
FIGS. 8A and 8B are illustrations showing an interface that displays a log and summary information for alerts.
Figure 8B:
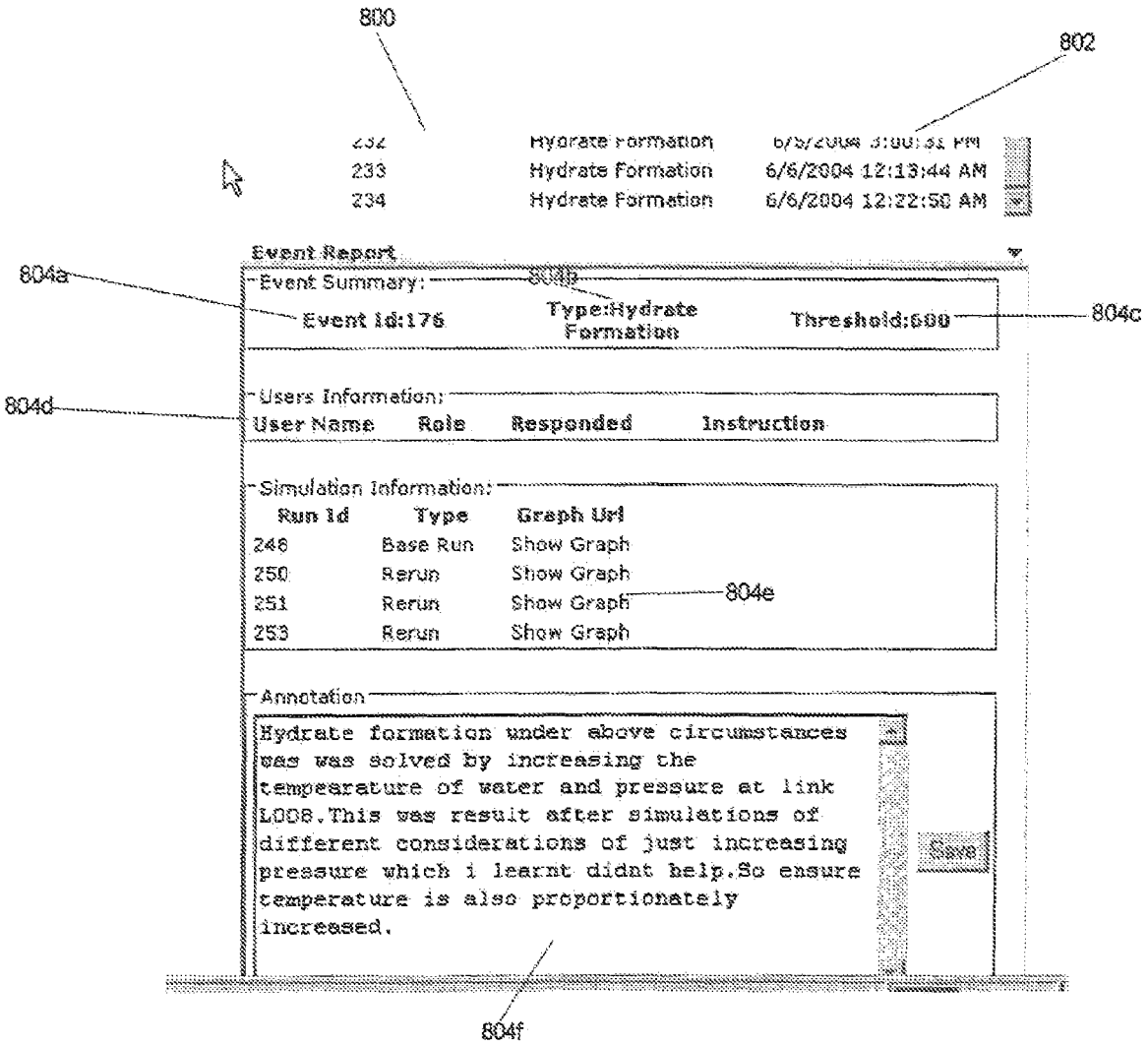

FIGS. 8A and 8B illustrate an interface 800 that displays a log of each time the operating curve and the flow assurance curve were forecasted to intersect, and a summary for each. The interface 800 is a web browser that displays a web page designed to display the log and summaries.

Interface 800 includes a section 802 that provides a list of items indicating each time the operating curve and the flow assurance curve were forecasted to intersect. Each item in the list contains a unique event ID, a brief description of the condition ("Hydrate Formation"), and the time of occurrence. When a user selects one of the items in the list, the corresponding summary of the event is displayed in a section 804 of interface 800.

Referring particularly to FIG. 8B, the summary includes the event ID 804*a*, the brief description of the condition 804*b*, and a numerical value 804*c* corresponding to the level of criticality of the event. The summary also includes information 804 about the users involved/alerted, their corresponding role, and any messages or instructions exchanged between the users. A section 804*f* includes any annotations that were made by the users involved in the event.

Also included in the summary is a list 804*e* of the various simulations performed by the users and the original calculation that initially forecasted the intersection. Included in list 804*e* is a link associated with each simulation and the original forecast. When a user selects a link, the corresponding graph showing the flow assurance curve and operating curve for the simulation or forecast is displayed in section 804 (as shown in FIG. 8A).

A number of implementations have been described. Nevertheless, it will be understood that various modifications may be made. For example, the foregoing techniques with respect to forecasting flow problems have been described as applied to hydrate formation in oil and gas production operations. However, the heavy process industries, which include oil & gas production, oil & gas refining, power generation, minerals and chemicals processing, waste and wastewater processing, and pulp and paper manufacturing, have a number of continuous processes where fluid formations may obstruct flow, both for the main fluid being processed and auxiliary fluids that heat or cool the main fluid to help separate fluid components or to enhance chemical reactions to convert the fluids. The various techniques may be applied to any of these flow assurance problems. Examples of other flow assurance problems to which the foregoing techniques may be applied include, for example, fouling of heat exchangers (long pipes with heating or cooling fluids that run adjacent to the pipes carrying the process fluid), and the deterioration in separation or conversion effectiveness of continuous industrial processes (pumping, compression, separation, distilling, conversion using catalysts or very high pressure and temperature).

In general, for instance, in implementations for other flow assurance problems, calculations can be performed to determine a boundary beyond which operating conditions of a fluid conduit are conducive to an occurrence of formations within the pipe, along with a curve representing operating conditions of the fluid conduit, and a forecast may be made as to whether the curves will intersect.

In addition, the techniques described with respect to assigning individuals to receive alerts based on levels of criticality may be applied to other events that occur in oil and gas production operations, as well as events in other heavy process industries. Examples of other events include quality problems such as trends in producing too much or too little against a contract, or producing too pure or too impure product, operations problems such as trends in achieving short-term goals at the expense of long-term goals (equipment will deteriorate too quickly), operations problems such as trying to avoid equipment failure or operations interruption by operating differently rather than stopping the equipment for maintenance based on trends in equipment or process performance, operations problems such as a forecasted unacceptable change in operations performance (quantity and quality) due to inability to deal with changes in raw material quantity or quality, operations problems such as tending to exhaust or exceed liquid inventory capacity, and operations problems such as a forecasted unacceptable change in operations performance (quantity and quality) due to forecasted changes in demand quantity or quality that are difficult to respond to.

Accordingly, other implementations are within the scope of the following claims.

What is claimed is:

1. A method comprising:

estimating a time remaining until operating conditions of a fluid conduit are conducive to an occurrence of formations within the fluid conduit;

determining a level of criticality based on the estimated time remaining;

determining one or more entities associated with the determined level of criticality;

generating an alert message regarding the estimated time remaining; and sending the alert message to the one or more determined entities.

2. The method of claim 1 further comprising:

calculating a boundary beyond which the operating conditions of the fluid conduit are conducive to the occurrence of formations within the fluid conduit;

calculating a curve representing the operating conditions of the fluid conduit; and forecasting a future intersection of the curve with the boundary, the future intersection representing that the operating conditions of the fluid conduit will be conducive to the occurrence of formations within the fluid conduit, and wherein estimating the time remaining until the operating conditions of the fluid conduit are conducive to the occurrence of formations within the fluid conduit comprises estimating a time period remaining until the curve will intersect with the boundary.

3. The method of claim 2 wherein estimating the rime period remaining until the curve will intersect with the boundary comprises:

calculating an average time rate of change of the curve; and estimating a time period remaining until the curve will intersect with the boundary based on the average time rate of change of the curve.

4. The method of claim 3 wherein estimating the time period remaining until the curve will intersect with the boundary based on the average time rate of change of the curve comprises estimating a time period remaining until the curve will intersect with the boundary at a temperature of intersection based on the average time rate of change of the curve.

5. The method of claim 3 wherein estimating the time period remaining until the curve will intersect with the boundary based on the average time rate of change of the curve comprises estimating a time period remaining until the curve will intersect with the boundary at a pressure of intersection based on the average time rate of change of the curve.

6. The method of claim 3 wherein estimating the time period remaining until the curve will intersect with the boundary further comprises:

calculating an average time rate of change of the boundary; and wherein estimating the time period remaining until the curve will intersect with the boundary based on the average time rate of change of the curve comprises estimating a time period remaining until the curve will intersect with the boundary based on the average time rate of change of the curve and the average time rate of change of the boundary.

7. The method of claim 1 wherein estimating the time remaining until the operating conditions of the fluid conduit are conducive to the occurrence of formations within the fluid conduit comprises estimating a time remaining until the operating conditions of the fluid conduit are conducive to an occurrence of hydrates within the fluid conduit.

8. The method of claim 1 further comprising:

creating a graph including the boundary and the curve; and displaying the graph to the one or more entities.

9. The method of claim 1 farther comprising enabling an entity that received the alert message to send a message to another entity.

10. The method of claim 1 farther comprising enabling an entity that received the alert message to enter proposed changes to the operating conditions of the fluid conduit and to initiate a simulation that determines an effect of the proposed changes on the boundary and the curve.

11. A system comprising:

a forecast component to:

estimate a time remaining until operating conditions of a fluid conduit are conductive to an occurrence of formations within the fluid conduit;

determine a level of criticality based on the estimated time remaining;

determine one or more entities associated with determined level of criticality, and generate an alert message regarding the estimated time remaining; and a communications component configured to send the alert message to the one or more determined entities.

12. The system of claim 11 farther comprising:

a curve calculation component configured to:

calculate a boundary beyond which the operating conditions of the fluid conduit are conducive to the occurrence of formations within the fluid conduit;

calculate a curve representing the operating conditions of the fluid conduit, and wherein:

the forecast component is configured to forecast a future intersection of the curve with the boundary, the future intersection representing that the operating conditions of the fluid conduit will he conducive to the occurrence of formations within the fluid conduit; and to estimate the time remaining until the operating conditions of the fluid conduit are conducive to the occurrence of formations within the fluid conduit, the forecast component is configured to estimate a time period remaining until the curve will intersect with the boundary.

13. The system of claim 12 further comprising:

a visualization component configured to create a graph including the boundary and the curve; and a presentation component configured to provide a display that includes the graph.

14. The system of claim 12 further comprising a presentation component configured to provide a display that includes an interface component that enables an entity that received the alert message to send a message to another entity that received the alert message.

15. The system of claim 12 further comprising a presentation component configured to provide a display that includes an interface component that enables an entity that received the alert message to enter proposed changes to the operating conditions of the fluid conduit and to initiate a simulation that determines an effect of the proposed changes on the boundary and the curve.

16. The system of claim 12 wherein, to estimate the time period remaining until the curve will intersect with the boundary, the forecast component is configured to: calculate an average time rate of change of the curve; and estimate a time period remaining until the curve will intersect with the boundary based on the average time rate of change of the curve.

17. The system of claim 16 wherein, to estimate the time period remaining until the curve will intersect with the boundary based on the average time rate of change of the curve, the forecast component is configured to estimate a time period remaining until the curve will intersect with the boundary at a temperature of intersection based on the average time rate of change of the curve.

18. The system of claim 16 wherein, to estimate the time period remaining until the curve will intersect with the boundary based on the average time rate of change of the curve, the forecast component is configured to estimate a time period remaining until the curve will intersect with the boundary at a pressure of intersection based on the average time rate of change of the curve.

19. The system of claim 16 wherein, to estimate the time period remaining until the curve will intersect with the boundary, the forecast component is configured to:

calculate an average time rate of change of the boundary, and wherein, to estimate the time period remaining until the curve will intersect with the boundary based on the average time rate of change of the curve, the forecast component is configured to estimate a time period remaining until the curve will intersect with the boundary based on the average time rate of change of the curve and the average time rate of change of the boundary.

20. The system of claim 11 wherein, to estimate the time remaining until the operating conditions of the fluid conduit are conducive to the occurrence of formations within the fluid conduit, the forecast component is configured to estimate a time remaining until the operating conditions of the fluid conduit are conducive to an occurrence of hydrates within the fluid conduit.

* * * * *

UNITED STATES PATENT AND TRADEMARK OFFICE

CERTIFICATE OF CORRECTION

PATENT NO. : 7,502,695 B2
APPLICATION NO. : 11/625144
DATED : March 10, 2009
INVENTOR(S) : Stanley DeVries It is certified that error appears in the above-identified patent and that said Letters Patent is hereby corrected as shown below:

On the Title Pg, Item (57) (Abstract), delete "well head" and insert --wellhead--;

In Column 17, line 49 (claim 3), delete "rime" and insert --time--;

In Column 18, line 22 (claim 9), delete "farther" and insert --further--;

In Column 18, line 25 (claim 10), delete "farther" and insert --further--;

In Column 18, line 31 (claim 11), delete "component to" and insert --component configured to:--;

In Column 18, line 33 (claim 11), delete "conductive" and insert --conducive--;

In Column 18, line 37 (claim 11), delete "with" and insert --with the--;

In Column 18, line 44 (claim 12), delete "farther" and insert --further--; and

In Column 18, line 54 (claim 12), delete "he" and insert --be--.

Signed and Sealed this

Fifteenth Day of December, 2009

David J. Kappos

David J. Kappos
*Director of the United States Patent and Trademark Office*